United States Patent [19]

Bobert et al.

[11] Patent Number: 4,843,853

[45] Date of Patent: Jul. 4, 1989

[54] TAMPERPROOF LOCK FOR VENDING MACHINES

[75] Inventors: David L. Bobert, Eagan; C. Roger Van Horn, Waconia, both of Minn.

[73] Assignee: Protocol, Inc., Mendota Heights, Minn.

[21] Appl. No.: 216,004

[22] Filed: Jul. 7, 1988

[51] Int. Cl.[4] ..... E05B 17/14; E05C 19/00

[52] U.S. Cl. ..... 70/427; 292/302

[58] Field of Search ..... 70/102, 129, 131, 232, 70/259, 427; 292/137, 138, 302

[56] References Cited

U.S. PATENT DOCUMENTS

| | | | |
|---|---|---|---|
| 1,125,822 | 1/1915 | Dodds | 292/302 |
| 1,573,579 | 2/1926 | Ross | 292/137 |
| 1,659,822 | 2/1928 | Innes | 292/302 |
| 2,074,133 | 3/1937 | Rodin | 292/137 |
| 4,068,506 | 1/1978 | Phelps | 292/138 |
| 4,401,247 | 8/1983 | Zoor | 70/232 |

*Primary Examiner*—Robert L. Wolfe
*Attorney, Agent, or Firm*—Moore & Hansen

[57] ABSTRACT

Apparatus for securely locking the cabinet of a vending machine to prevent unauthorized access to the coin box and/or product being vended. The cabinet comprises a box-like housing having an access door hinged along one edge to a side wall of the cabinet. The opposite side wall from the one carrying the hinge includes a plurality of spaced-apart tubular members either integrally formed with the side wall or welded thereto along a length dimension thereof. Likewise, the edge of the door panel opposite the hinge also has spaced-apart tubular members along its length. The spacing between the tubular members on the cabinet's side panel and the door edge are such that when the door is closed, the tubes are longitudinally aligned with one another. An aperture is formed in the bottom wall in general alignment with the tubular members on the side panel allowing a locking rod to be inserted upwards through the aperture and into the central openings of the aligned tubes utilizing a special tool. The locking rod is fully contained within the cabinet. A key operated lock is mounted in the bottom panel of the cabinet and has an L-shaped hardened steel plate attached to the lock whereby when the key is inserted and turned, the plate can be made to assume a blocking disposition relative to the aperture, precluding access to the locking rod except by authorized persons having a key.

5 Claims, 1 Drawing Sheet

TAMPERPROOF LOCK FOR VENDING MACHINES

BACKGROUND OF THE INVENTIONS

I. Field of the Invention

This invention relates generally to means for securing the access door on a vending machine cabinet, and more particularly to a low-cost locking mechanism which is extremely difficult to defeat by thieves or vandals.

II. Discussion of the Prior Art

A wide variety of products are sold through vending machines wherein a customer deposits money and, when an amount equal to the vend price has been entered, a product may be dispensed. Some vending machines are often left unattended for prolonged periods of time and unauthorized persons frequently attempt to steal the money deposited by customers or the inventory of product contained within the vending machine cabinet. Sophisticated locking arrangements can be devised, but this adds to the overall cost of the vending machine and, in many instances, cannot be justified. Other known lock arrangements are so simple that they can be readily defeated with various types of hand tools, such as bolt cutters, hacksaws and crow bars. For example, when a simple padlock is used, it becomes quite simple to cut through the hasp or the shackle of the lock with a saw. Other types of locks, such as key-operated barrel locks, having a rotatable latch plate, are not sufficiently strong to stand up to a pry bar. Thus, a need exists for a lock arrangement for a vending machine which can be implemented at relatively low cost, but which is highly resistant to being defeated by thieves or vandals.

SUMMARY OF THE INVENTION

The present invention provides a tamperproof lock arrangement for a vending machine of the type including a box-like housing or cabinet which is adapted to be mounted on a wall or post and which includes a stationary panel which is hinged along one edge thereof to a vertical side wall of the cabinet, allowing the cabinet to swing like a door between an open and a closed disposition relative to the stationary panel. The opposite edge of the stationary panel includes a plurality of tubular members which are spaced longitudinally from one another but whose central openings are aligned vertically. In a like manner, a plurality of tubular segments are attached to the front edge of the cabinet wall opposite from the one on which the hinge is located. The spacing between the tubular members on the door and on the cabinet are such that they are interdigitated when the cabinet is in its closed disposition relative to the stationary panel. A small opening is provided in the cabinet's bottom panel in general alignment with the tubular members on the cabinet's side panel. This allows an elongated locking rod and a locking rod insertion tool to be fitted vertically upward therethrough with the locking rod passing through the central openings of the interdigitated tubular members. Once the locking rod is so placed, the insertion tool can be removed.

Also formed in the bottom panel adjacent the rod/-tool opening is a key-operated barrel lock having an L-shaped steel plate affixed thereto. By inserting a key and turning it, the plate moves in a covering relation relative to the rod/tool receiving aperture. The lock itself is designed to be pick-proof, drill-proof and punch-proof and thus virtually precludes a thief from removing the lock rod.

DESCRIPTION OF THE DRAWINGS

The foregoing features and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
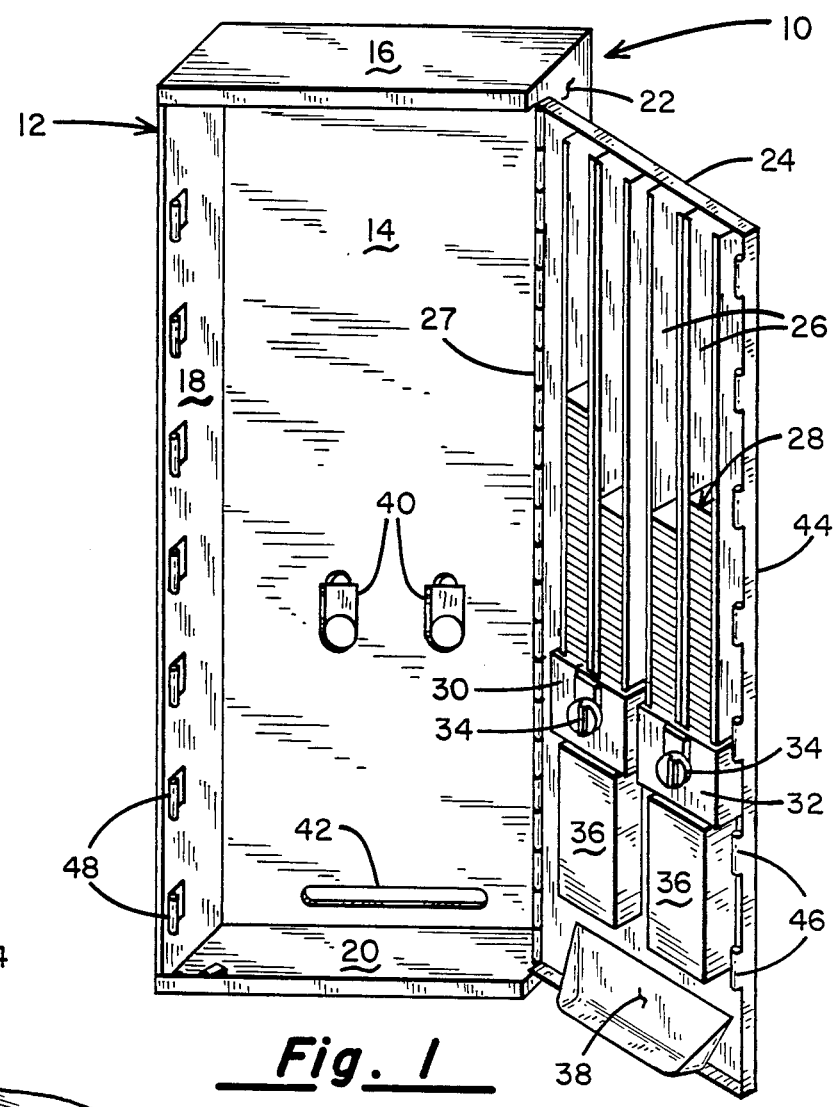
FIG. 1 is a perspective view of a vending machine cabinet incorporating the locking arrangement of the present invention.

Referring to FIG. 1, there is indicated generally by number 10 a vending machine which is seen to comprise a box-like housing or cabinet 12 having a front panel 14 and four mutually perpendicular side panels 16, 18, 20 and 22, either integrally joined with or welded to the front panel 14. A generally flat, rectangular door panel 24 is hinged about its longitudinal edge 26 to the outer edge of the side wall 22. Thus, when the door panel 24 is fixed to a stationary object, the cabinet 12 can be rotated from the position which it is illustrated in FIG. 1 to a position wherein the door panel 24 becomes generally parallel with the front panel 14.

Mounted on the inside surface of the door panel 24 are a plurality of vertical trays 26 in which a supply of products to be vended are stacked as at 28. Disposed immediately below each of the product stacks 28 is a coin mechanism as at 30 and 32. The deposit of the vend price into the coin mechanism allows the knobs 34 to be rotated whereby the coins so deposited drop into the coin boxes 36 while the bottommost package in one of the product tubes 26 falls into the tray 38. The apertures 40 in the front panel 14 allow the coin slot on the coin mechanisms as well as the vending knobs 34 to be accessed through the front panel 14 by the customer. The slot 42 also formed in the front panel makes it possible for the customer to reach into the tray 38 to pick up the vended item.

The locking mechanism with which the present invention is primarily concerned will next be described. Integrally formed along the outer edge 44 of the door panel 24 are a series of spaced-apart tubular segments 46. Likewise, affixed to the interior surface of the side wall 18 at regularly spaced intervals are tubular members 48. The relative spacing of the tubular members 46 and the tubular members 48 is such that when the door panel 24 is closed relative to the cabinet 12, the tubular segments are interdigitated with the central openings in each of the tubes being colinear.

Figure 2:
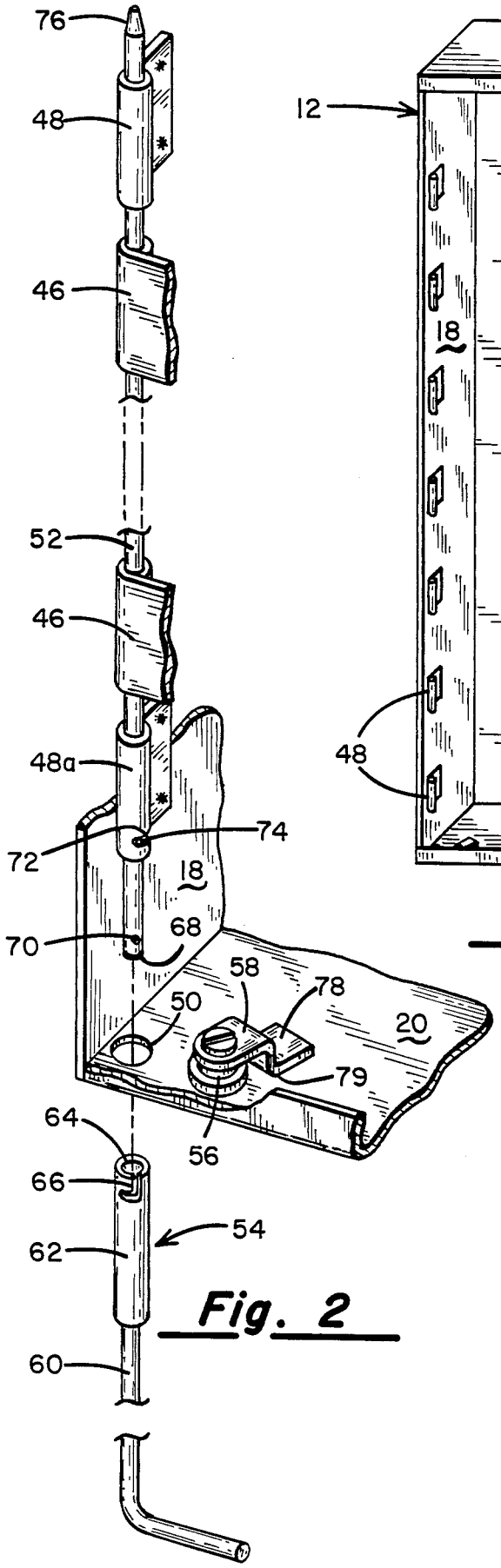
FIG. 2 is an enlarged sectional view showing the locking bar insertion/removing tool being used with the locking device of the present invention.

Referring now to FIG. 2, it can be seen that there is provided in the lower side panel 20 a circular opening 50 of a predetermined diameter sufficient to allow a cylindrical locking bar 52 and a locking bar insertion tool 54 to be inserted therethrough. Positioned adjacent to the aperture 50 in the plate 20 is a key operated cylinder lock 56 of the type in which when an appropriate key is inserted into the keyhole (not shown) and turned, the barrel portion of the cylinder lock will also rotate. Affixed to the barrel is a hardened steel gate member 58 which is appropriately dimensioned so that it can be rotated to the point where it can be made to selectively block or unblock the aperture 50. With no limitation intended, a cylinder lock suitable for use in the present embodiment may be of the type manufactured by the Medeco Division of Hillenbrand Industries. Such locks are highly resistant to being picked, drilled or punched by individuals wishing to gain unauthorized access to the products or money contained within the vending machine cabinet.

The tool 54 used to install the locking bar 52 is seen to comprise an elongated handle 60 having a cylindrical socket member 62 affixed thereto. The socket member 62 includes a central bore 64 formed longitudinally therein and an L-shaped slot 66 extends through the wall of the cylinder 62 to communicate with the bore 64. It is apparent, then, that the locking bar 52 may have its lower end 68 inserted into the bore 64 with the radially extending pin 70 projecting therefrom residing in the L-shaped slot of the tool 54.

In a somewhat similar fashion, the lowermost one of the tubular members 48, identified in FIG. 2 by numeral 48*a*, also includes an L-shaped slot 72 formed through the side wall thereof for receiving a radially-extending pin 74 attached to the locking rod 52. The horizontal branch of the L-shaped slot 74 extends in the same direction as that in slot 66.

To lock and thereby secure the vending machine from unauthorized entry, the vending machine serviceman will fit the lowermost end 68 of the locking bar 52 into the bore 64 of the tubular portion 62 of the insertion tool 54 with the pin 70 residing in the horizontal branch of slot 66. The upper end 76 of the locking rod is then inserted from the bottom through the aperture 50 and through the aligned tubular openings 48 and 46 until the pin 74 is guided through the L-shaped slot 72 in the lowermost tubular member 48*a*. Rotation of the tool at this point will cause the pin 74 to reside in the horizontal portion of the L-shaped slot 72 while further rotation of the tool 54 will cause the pin 70 to become aligned with the vertical portion of the L-shaped shaped slot 66. The tool can then be pulled downward and removed from the aperture 50 leaving the locking rod 52 in place. Next, by operating the key in the barrel lock 56, the gate plate 58 may be rotated to the point where it blocks the aperture 50. Removal of the key at this point leaves the gate 58 in its blocking disposition relative to the aperture 50.

Opening of the vending machine for servicing involves just the opposite set of steps. That is, the serviceman will insert his key into the lock 56 and rotate the gate member 58 to the position shown in FIG. 2, again allowing the tool 54 to be inserted and rotated to the point where the pin 74 becomes aligned with the vertical portion of the L-shaped slot 72 such that the locking bar 52 can now fall down and out through the aperture. Once so removed, the cabinet 12 can be pivoted about the hinge 26 giving the serviceman access to the coin boxes and the product tubes.

Figure 3:
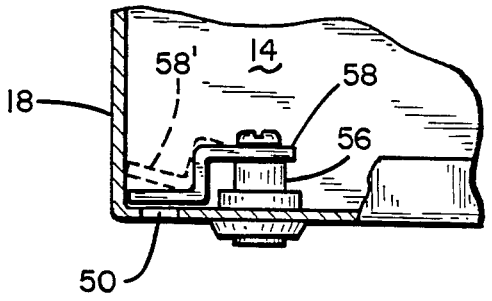
FIG. 3 is a detailed view showing the way in which unauthorized entry if defeated.

It is to be noted that the gate member 58 is bent at a right angle at 78 and at 79 and the dimensions are such that when the gate member 58 is rotated to its blocking position relative to aperture 50, the outer edge of the gate member 58 closely abuts the vertical side wall 18 of the cabinet 12. Should a vandal or would-be thief try to insert a punch to force the plate 58 out of the way, a portion of the gate member will become tightly wedged up against the vertical side wall 18, thereby effectively preventing the gate member 58 from being bent. This is more clearly seen in FIG. 3.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A tamperproof lock arrangement for a vending machine of the type including a box-like housing having a front panel with first, second, third and fourth mutually perpendicular side panels extending outwardly from said front panel and a door panel, said door panel being hinged along one edge thereof to the outer edge of said first of said side panels for rotation between an open and a closed disposition relative to said box-like housing, said lock arrangement comprising, in combination:

(a) a plurality of tubular members affixed at spaced-apart aligned locations along the outer edge of said second side panel, said second side panel being parallel to said first side panel that is hinged to said door panel;

(b) a plurality of tubular members affixed at spaced-apart aligned locations along the edge of said door panel which is opposite to said one edge, the tubular members on said door panel fitting between the tubular members on said second side panel when said door is in its closed disposition;

(c) an aperture formed through said third side panel in general alignment with said plurality of tubular members affixed to said second side panel;

(d) a key-operated lock mounted on said third side panel and having a plate member projecting from said lock within said enclosure and movable between a blocking and an open position relative to said aperture when a proper key is inserted and turned in said lock; and (e) a locking rod insertable through said aperture when said plate member is in said open position and through said aligned tubular members on said second side panel and on said door panel.

2. The tamperproof lock arrangement as in claim 1 wherein the tubular member closest to said aperture has a L-shaped slot extending through the thickness dimension thereof.

3. The tamperproof lock arrangement as in claim 2 wherein said locking rod includes a radially projecting pin extending normal to said locking rod for insertion into said L-shaped slot.

4. The tamperproof lock arrangement as in claim 3 and further including a locking rod insertion/removal tool for guiding said pin into said L-shaped slot.

5. The tamperproof lock arrangement as in claim 1 wherein said plate member on said lock is bent at a right angle and the free end of said plate member closely abuts said second side panel when said plate is in said blocking disposition relative to said aperture.

* * * * *